United States Patent [19]

Peterson

[11] 4,278,239

[45] Jul. 14, 1981

[54] VEHICLE WINCH

[75] Inventor: Gunnar S. S. Peterson, Vansbro, Sweden

[73] Assignee: Sepson Aktiebolag, Vansbro, Sweden

[21] Appl. No.: 8,938

[22] Filed: Feb. 2, 1979

[30] Foreign Application Priority Data

Feb. 15, 1978 [SE] Sweden ..... 7801765

[51] Int. Cl.[3] ..... B66D 1/00

[52] U.S. Cl. ..... 254/323; 254/342

[58] Field of Search ..... 254/166, 186 R, 323, 254/325, 326, 342; 242/86.5 R, 84.1 A

[56] References Cited

U.S. PATENT DOCUMENTS

| | | | |
|---|---|---|---|
| 2,664,253 | 12/1953 | Therrien | 242/86.5 R |
| 3,027,141 | 3/1962 | Ellis | 254/166 |
| 3,088,709 | 5/1963 | Hunt | 254/166 |
| 3,719,331 | 3/1973 | Harsch | 242/86.5 R |
| 3,829,064 | 8/1974 | Jackson | 254/166 |
| 4,033,552 | 7/1977 | Kuzarov | 254/166 |

FOREIGN PATENT DOCUMENTS

| | | |
|---|---|---|
| 1141551 | 3/1957 | France . |
| 403275 | 3/1978 | Sweden . |

*Primary Examiner*—Billy S. Taylor

*Attorney, Agent, or Firm*—Schuyler, Banner, Birch, McKie & Beckett

[57] ABSTRACT

A vehicle winch detachably connected to a vehicle comprises a line drum, a motor and a driving unit detachably connected to each other in order to be manually moved as separate units to a place at a distance from the vehicle and at that place be detachably connected to each other again. The motor is separated from and lacks connections with the vehicle when the winch is working at a distance therefrom.

5 Claims, 1 Drawing Figure

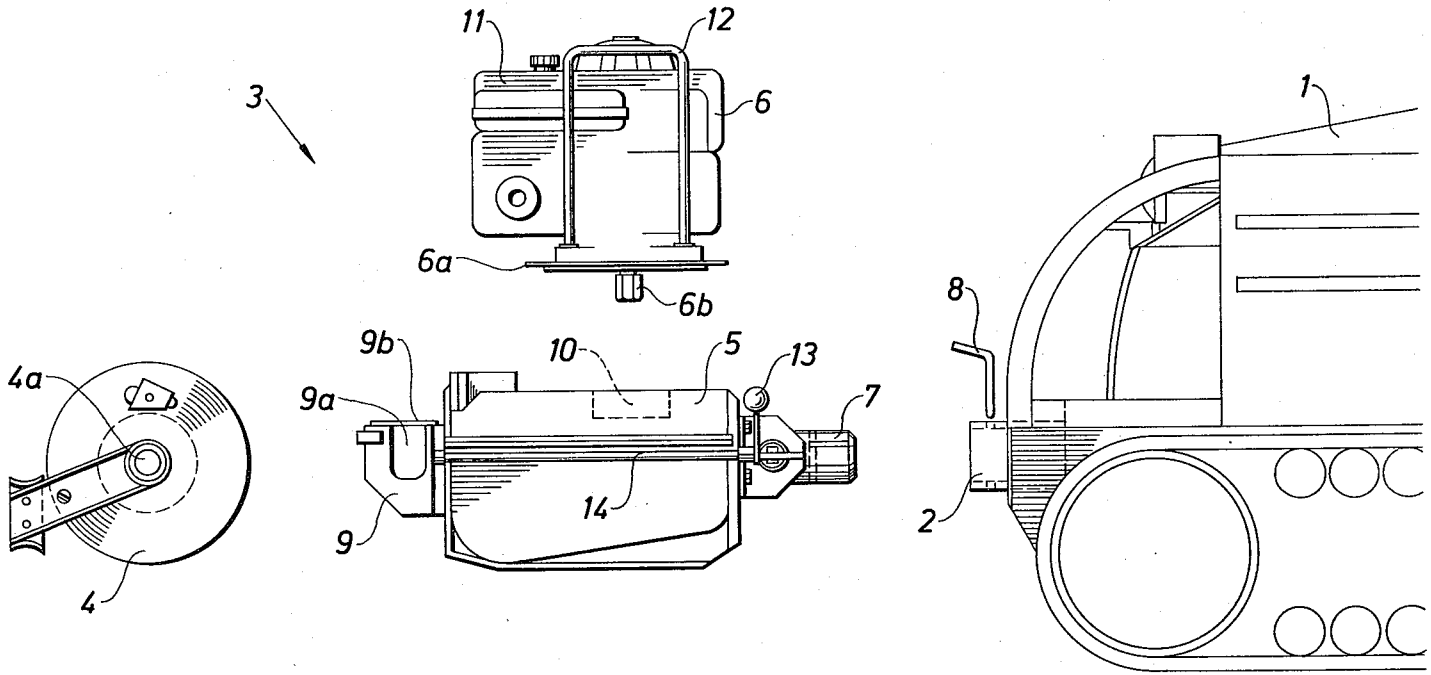
1
8
2
7
13
5
10
14
9b
9a
9
4a
4
3
12
6
6b
11
6a

VEHICLE WINCH

The present invention refers to a vehicle winch comprising a line drum, a motor and a driving unit for transferring driving power from the motor to the line drum.

It is previously known to detachably connect winches to vehicles. If the winch is big and heavy lifting devices are required to remove it from a place on the vehicle and transfer it to another place on the vehicle or to another vehicle to which it is to be connected.

Winches are also known each one of which consists of a motor, a driving unit and a line drum connected to each other. These winches, which often are used as yarding winches, are heavy and bulky and cannot be moved manually from a place to another. Neither can they be connected to vehicles to function as vehicle winches nor can they be demounted into units to facilitate repair and maintenance work.

Therefore, it is an object of the present invention to remove the disadvantages with previously known winches and to provide a winch which can be moved manually between different places on a vehicle, between different vehicles or from a vehicle to a place at a distance from the vehicle, which can be used arbitrarily as vehicle winch or stationary winch (yarding winch, for example), which can be easily repaired and which can work without power supply from the vehicle normally carrying the winch.

This object if fulfilled by giving the winch according to the invention the characteristics stated in the claims.

A preferred embodiment of the invention will now be described in conjunction with the enclosed drawing the only FIGURE of which shows a side view of the different main units of the winch taken apart and a vehicle on which the winch may be detachably mounted. The arrows on the drawing show the directions in which the units and vehicle are to be moved into their assembled relationship.

On the FIGURE a vehicle, which is a crawler, is designated 1. In its front the vehicle 1 is provided with a sleeve 2 forming a first part of an attachment device. A winch 3 intended to be mounted on the vehicle 1 consists of three main units, namely a line drum 4, a driving unit 5 and a combustion engine 6. A stub shaft 7 is preferably detachably connected to the driving unit 5 and forms the second part of the attachment device. The shaft 7 fits in the sleeve 2 and after having been inserted therein it may be detachably secured to the sleeve by means of a pin 8, for instance, inserted into holes in the sleeve and in the shaft. Instead of the sleeve 2 being connected to the vehicle 1 and the shaft 7 being connected to the driving unit 5 the shaft may be connected to the vehicle and the sleeve to the driving unit.

The driving unit 5 is provided with two parallel spaced arms 9 protruding from its left end in the FIGURE. Only one of the arms is shown in the FIGURE. Each arm has an upwardly open recess 9*a*. When the winch is assembled the shaft 4*a* of the line drum 4 is inserted and rotatably supported in the recesses 9*a* and is maintained in that position by means of a schematically shown bearing cap 9*b* detachably mounted on each arm 9. In this position a gear 4*b* on one end of the drum 4 engages a gear 5*a* in the driving unit 5. The positions th at shaft 4*a* and gear 4*b* will assume when the line drum 4 is mounted on driving unit 5 are shown in phantom lines.

The driving unit 5 is also provided with an upwardly open recess indicated at 10 in the FIGURE and including a rotatable gear with a central hexagonal hole 10*a*. This gear forms part of the gearing in the driving unit 5 the output shaft of which carries the gear 5*a* engaging the gear 4*b* on the end of the drum 4. When the winch is assembled a flange 6*a* on the motor 6 bears on the upper planar surface of the driving unit 5 and is locked to the driving unit by means of wing nuts engaging screws (not shown) connected to the driving unit 5 and extending through slits or holes in the flange 6*a*. In this position the output end 6*b* of the motor shaft having a hexagonal cross section engages within the above described hexagonal hole 10*a* in the gear of the above described driving unit gearing, and during the rotation of the motor shaft the driving power is transferred to the drum 4 via the gearing in the driving unit 5.

When the winch 3, assembled as described, is to be removed from the vehicle 1 and mounted on another vehicle or be used as a stationary winch at a distance from the vehicle the wing nuts (not shown), which lock the flange 6*a* of the motor 6 to the driving unit, are loosened. Thereafter, the motor with its fuel tank 11 and other required equipment is lifted so that the shaft end 6*b* is disconnected from the hexagonal hole 10*a* in the gear in the gearing of the driving unit 5. The motor 6 is then carried to the place where the winch will be used. Carrying the motor is facilitated by means of a number of handles 12 fastened to the motor, one of which being shown in the FIGURE.

After the motor 6 has been demounted and removed the bearing caps 9*b* are removed and the drum 4 is lifted so that the shaft 4*a* is removed from the recesses 9*a* in the arms 9. Thereafter the drum 4 is carried to the place where the winch will be used.

Finally, the pin 8 is removed from the sleeve 2 and from the stub shaft 7 and the driving unit 5 is withdrawn from the vehicle 1. By means of handles 13 and 14 the driving unit is carried to the place where the winch will be used.

When the winch shall be used again the motor 6 and the drum 4 are connected to the driving unit 5 resting on the ground or mounted on another vehicle. In case the winch shall be stationary it is detachably connected to a suitable fixed base or object.

From the above description it should have become apparent that a winch which previously could not be moved without the aid of lifting equipment due to the present invention can be moved manually even in difficult terrain where vehicles cannot be driven. From the description it should also have become clear that the winch according to the invention may be located and may work anywhere and at any distance from the vehicle normally carrying it because it has a power source of its own. Moreover, the repair and maintenance work is facilitated because a damaged driving-, motor-or drum unit easily may be removed from the other units and transported to a workshop for repair or may be exchanged for a spare unit.

Even if only one embodiment of the invention has been described and shown it should be understood that the invention is not limited to this embodiment but is only limited to that which is stated in the following claims.

I claim:

1. A vehicle mountable winch that is readily separable into three main units for ease in manually moving said units individually and subsequent reassembly in relocating said winch comprising:

a line drum provided with support means for rotatably supporting said drum incident winding of a line on or off said drum;

a driving unit provided with a laterally extending mounting part of an attachment device to enable mounting said winch on a vehicle and having carrier means detachably cooperable with said support means of said drum to fixedly mount said drum on said driving unit, said driving unit defining an upwardly facing motor support surface and having therewithin detachably engagable upwardly opening input driven means and output drive means;

a motor having rotatable output shaft means drivingly cooperating with and extending downwardly into said input driven means within said driving unit, said motor being detachably mounted on said support surface of said driving unit to bear on the upper surface of said driving unit and transmit driving power from said motor into said driving unit; and drive transmitting means rotatable with said line drum and drivingly engaged with said output drive means within said driving unit when said support means of said drum is cooperably attached with said carrier means of said driving unit, said drive transmitting means being easily disengaged from said output drive means when said support means is detached from said carrier means of said driving unit.

2. A vehicle mountable winch as recited in claim 1 wherein said driving unit includes gearing therewithin with said shaft means being a shaft drivingly cooperating with said gearing.

3. A vehicle mountable winch as recited in claim 1 wherein said support means of said line drum is a shaft which is rotatably supported on spaced parallel arms extending from said driving unit that provide said carrier means of said driving unit.

4. Vehicle winch according to claim 1 or 2, wherein said motor is a combustion engine to which is connected at least one fuel source.

5. Vehicle winch according to claim 1 wherein at least one of said driving unit and said motor is provided with handles.

* * * * *

UNITED STATES PATENT AND TRADEMARK OFFICE

CERTIFICATE OF CORRECTION

PATENT NO. : 4,278,239

DATED : July 14, 1981

INVENTOR(S) : Gunnar S. S. Peterson

It is certified that error appears in the above—identified patent and that said Letters Patent is hereby corrected as shown below:

On The Title Page and the sole sheet of Drawing:

The Drawing Figure should appear as shown on the attached sheet.

Signed and Sealed this

*Eighth* Day of *December 1981*

[SEAL]

*Attest:*

GERALD J. MOSSINGHOFF

*Attesting Officer*

*Commissioner of Patents and Trademarks*

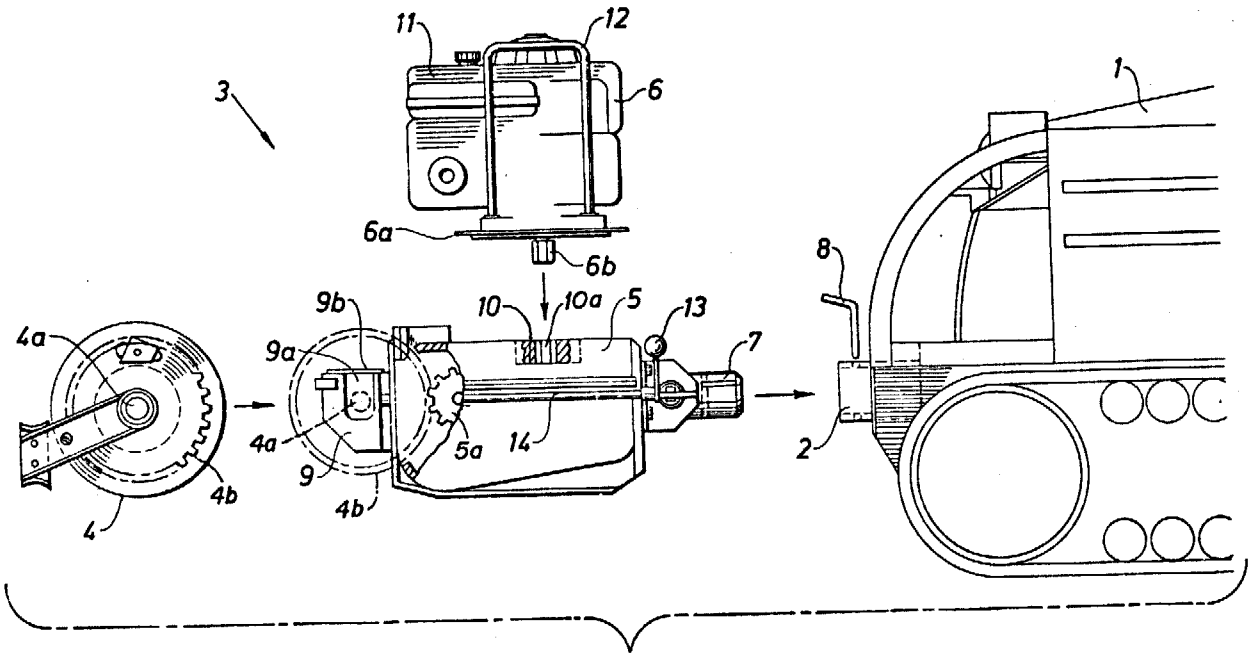
1
8
2
7
13
5
10a
10
14
5a
12
6
6b
11
6a
9b
9a
4a
9
4b
3
4b
4a
4